US008484786B2

(12) United States Patent
Anderberg

(10) Patent No.: US 8,484,786 B2
(45) Date of Patent: Jul. 16, 2013

(54) RAMP FOR A MOVABLE PASSENGER BRIDGE FOR A SHIP

(75) Inventor: Nils-Erik Anderberg, Trelleborg (SE)

(73) Assignee: FMT International Trade AB, Trelleborg (SE)

( * ) Notice: Subject to any disclaimer, the term of this patent is extended or adjusted under 35 U.S.C. 154(b) by 0 days.

(21) Appl. No.: 13/367,016

(22) Filed: Feb. 6, 2012

(65) Prior Publication Data

US 2012/0204361 A1 Aug. 16, 2012

(30) Foreign Application Priority Data

Feb. 7, 2011 (SE) ..... 1150084

(51) Int. Cl.
*E01D 1/00* (2006.01)

(52) U.S. Cl.
USPC ..... 14/71.5

(58) Field of Classification Search
CPC ..... B64F 1/305
USPC ..... 14/69.5–72.5
See application file for complete search history.

(56) References Cited

U.S. PATENT DOCUMENTS

| | | | | |
|---|---|---|---|---|
| 427,378 | A * | 5/1890 | Thomson | 182/1 |
| 4,115,887 | A * | 9/1978 | Ewards | 114/362 |
| 5,791,003 | A * | 8/1998 | Streeter et al. | 14/71.5 |
| 6,526,615 | B1 * | 3/2003 | Hutton et al. | 14/71.5 |
| 6,668,411 | B1 | 12/2003 | Anderberg | |
| 6,684,443 | B2 * | 2/2004 | Thomas et al. | 14/71.5 |
| 6,923,140 | B1 * | 8/2005 | Cook | 114/362 |
| 8,006,337 | B2 * | 8/2011 | Birmingham et al. | 14/71.1 |
| 2002/0104176 | A1 * | 8/2002 | Thomas et al. | 14/71.5 |
| 2002/0138924 | A1 | 10/2002 | Rolfe et al. | |
| 2010/0175608 | A1 * | 7/2010 | Heckaman et al. | 114/362 |
| 2012/0110754 | A1 * | 5/2012 | Provost | 14/71.1 |
| 2012/0279417 | A1 * | 11/2012 | Charbonneau et al. | 105/348 |

FOREIGN PATENT DOCUMENTS

| | | | |
|---|---|---|---|
| CN | 101161942 | A | 4/2008 |
| CN | 101768918 | A | 7/2010 |
| DE | 2030926 | A1 | 4/1971 |
| GB | 2111449 | | 7/1983 |
| JP | 2002167054 | | 6/2002 |
| WO | 9819910 | A1 | 5/1998 |

OTHER PUBLICATIONS

International Search Report, dated Jun. 1, 2012, from corresponding PCT application.

* cited by examiner

*Primary Examiner* — Raymond W Addie
(74) *Attorney, Agent, or Firm* — Young & Thompson

(57) ABSTRACT

Ramp for a movable passenger bridge, which passenger bridge includes movable sections, arranged to be adapted to an opening in the hull of a ship, which sections are arranged so that passengers can walk from one section into an adjacent section and to a finishing section arranged to be connected to an opening in the hull of the ship, wherein the ramp is arranged at the finishing section and projects from the finishing section into the ship when docked with the ship. The ramp includes two or more parallel footpaths for passengers, in that each footpath includes a plate which is foldable so that it can be folded out and folded up, in that each plate is essentially horizontal in its folded out state and essentially vertical in its folded up state, whereby each plate in its folded up state forms a wall for blocking of the footpath in question.

13 Claims, 3 Drawing Sheets

15
16
22
23
24
25
26
27
28
29
30
31
32
33
34
35
36
-26-
-27-

RAMP FOR A MOVABLE PASSENGER BRIDGE FOR A SHIP

The present invention relates to a ramp for a movable passenger bridge for a ship.

Such a passenger bridge is arranged to preferably be connected, at one of its ends, to a terminal building, and arranged to, with its other end, be connected to a door opening in the hull of a ship.

The passenger bridge comprises several sections of passenger bridges, connected one to the other so that passengers can walk through one section and into another section.

The applicant's own U.S. Pat. No. 6,668,411 discloses a passenger bridge of this type. The passenger bridge according to the said US patent comprises an odd number of sections of passenger bridges, however at least three. Between said sections, there are shorter passenger bridges, in the form of transfer sections by the use of which passengers walk from one section of the passenger bridge to another section. The sections can be individually raised and lowered, so that the first end of the passenger bridge can be connected to a terminal building or the corresponding, and so that the other end of the passenger bridge can be connected to a door in the hull of a ship.

Furthermore, the sections are arranged to form an angle to the horizontal plane, in order to adapt to elevation differences between an entrance/exit into or out from a terminal building and the said door in the hull of the ship.

A ramp of the present type projects from the section of the passenger bridge which is connected to the ship. The ramp extends from the section of the passenger bridge at the ship and a certain distance into the ship, so that the passengers safely can embark and disembark without risking there being a distance between the ship and the free end of the ramp.

Moreover, the passenger bridge is supported by a frame, which frame supports the sections and the transfer sections. The frame, in turn, is supported by a number of wheels, resting on a quay on which the ships are landed. The passenger bridge is movable along two mutually perpendicular directions, by one or several wheels being driven.

At least the section the free end of which is to be connected to a ship may be telescopic in its longitudinal direction.

A problem with such passenger bridges is that they should be adaptable to all passenger ships that make the port in which the passenger bridge is present.

Different ships have differently sized openings with different positions in the hull for the embarking and disembarking of the passengers.

For this reason, so far ramps have been dimensioned for a narrower hull opening, where at least one passenger with luggage can fit comfortably. However, narrow ramps result in that embarking and disembarking of passengers take a long time, especially when the number of passengers is large. On cruise liners, it is common to have thousands of passengers. Therefore, ships of a more modern type often have relatively broad openings in their hulls for embarking and disembarking. However, this results in that broader openings cannot be fully used in case the ramp is narrow.

The present invention solves this problem. Hence, the present invention relates to a ramp for a movable passenger bridge for embarking and disembarking passengers to/from a ship, which passenger bridge comprises a number of movable sections of the passenger bridge, arranged to be adapted to an opening in the hull of a ship, which sections are arranged so that passengers can walk from one section into an adjacent section and to a finishing section arranged to be connected to an opening in the hull of the ship, wherein said ramp is arranged at the finishing section and projects from said finishing section into the ship when docked with the ship, and is characterised in that the ramp comprises two or more parallel footpaths for passengers, in that each footpath comprises a plate which is foldable so that it can be folded out and folded up, in that each plate is essentially horizontal in its folded out state and essentially vertical in its folded up state, whereby each plate in its folded up state forms a wall for blocking of the footpath in question.

Below, the invention is described in closer detail, partly in connection to an embodiment of the invention shown on the enclosed drawings, where FIG. 1 shows a passenger bridge, in which the invention is applied.

FIG. 2 shows the ramp which is closest to the viewer in its folded out state and the second ramp in its folded up state and where FIG. 3 shows the ramp which is closest to the viewer in its folded up state and the second ramp in its folded out state.

Figure 1:
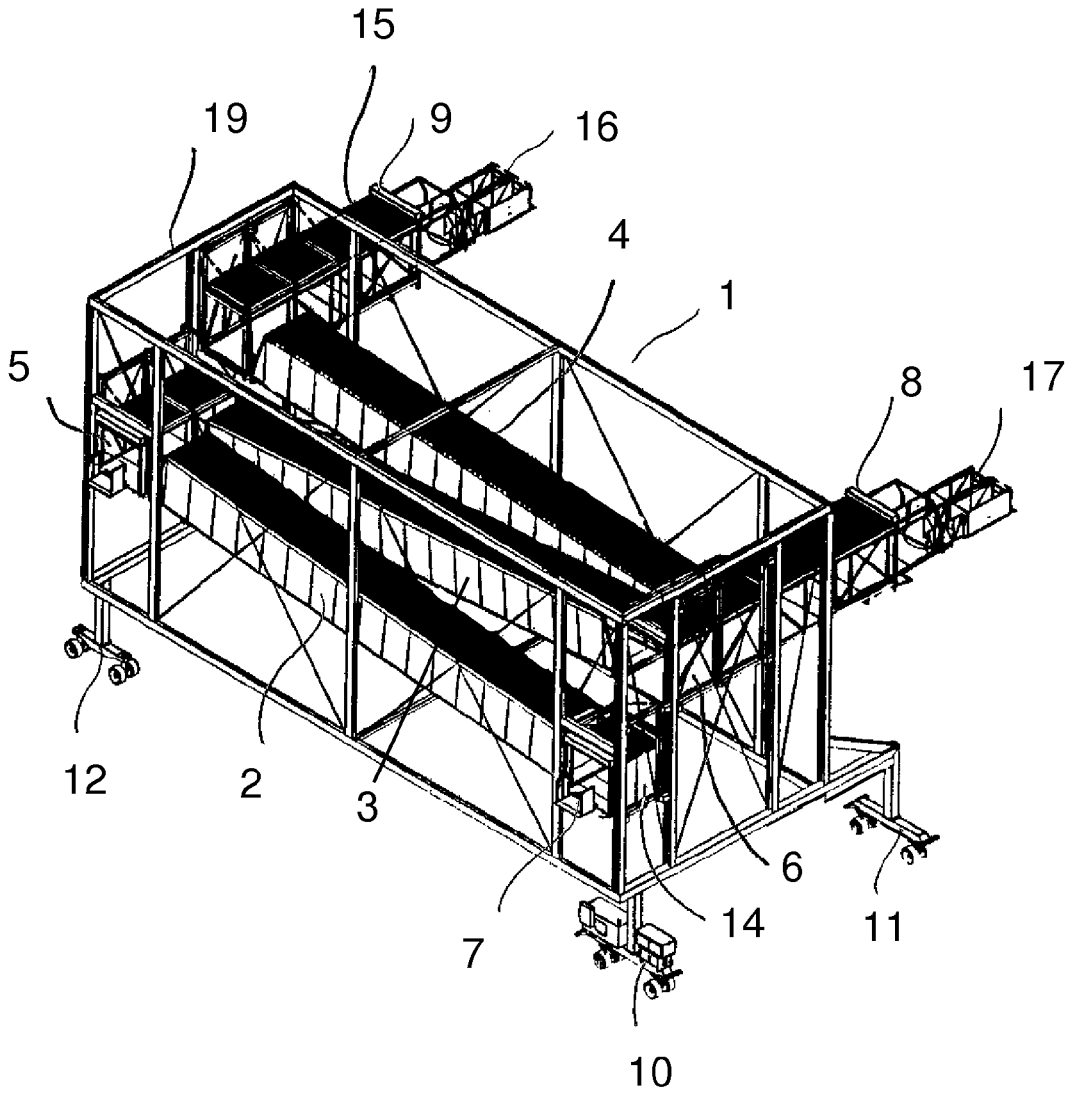

In FIG. 1, a movable passenger bridge 1 for embarking and disembarking a ship is shown, wherein the invention is applied.

The passenger bridge 1 comprises a number of sections 2, 3, 4 of the passenger bridge, where two adjacent sections are connected at their respective ends using shorter transfer sections 5, 6 arranged so that passengers can walk from one section and into an adjacent section via a transfer section.

The sections 2, 3, 4 and the transfer sections 5, 6 are supported by a framework 19 of steel beams.

The said sections 2, 3, 4 are displacably arranged relative to the framework 19, so that these can form an angle to the horizontal plane, in order so that a height difference between a first port 7, arranged to be connected to an opening in a terminal building or the like, and a second port 8, 9, arranged to be connected to an opening in the hull of the ship can be absorbed.

The framework 19 is supported by wheel arrangements 10-12, whereof three are visible in FIG. 1, arranged to abut against a quay. At least one wheel arrangement 10 is arranged to be driven in order to manoeuvre the passenger bridge 1 on the quay. This and the other three wheel arrangements are pivotable about a vertical axis.

To displace and adjust the sections and, as mentioned below, a transfer section, as well as for manoeuvring of the passenger bridge on the quay, there is a control system of a suitable known type.

In FIG. 1, sections 2, 3, 4 and the transfer sections 5, 6 are shown in different height positions relative to the framework.

Hence, passengers which are to embark walk from for instance a terminal building and into port 7, and then walk through section 2, transfer section 5, section 3, transfer section 6, section 4 and out through port 9 into the ship.

An entry module 14 is positioned at the said first port 7.

According to an embodiment, the transfer section 6 located at the entry module 14 and/or a finishing section 15 located furthest away from the entry module 14, is arranged with the said second port 8, 9.

The said sections can be arranged with a width so that two or several passengers comfortably can walk one next to the other. However, with the known art, a bottleneck arises at the ramps to be connected or docked with an opening into the ship, since the ramps are dimensioned for the narrowest occurring openings into ships, because the passenger bridge is to be usable with different ships.

Thus, the present invention relates to a ramp 16, 17 for a movable passenger bridge for embarking and disembarking passengers to/from a ship. The said ramp 16, 17 is arranged at the finishing section 15 and the transfer section 6, respectively, and projects from the said respective section 15, 6 into the ship when docking with the ship.

Figures 2, 3, 4:
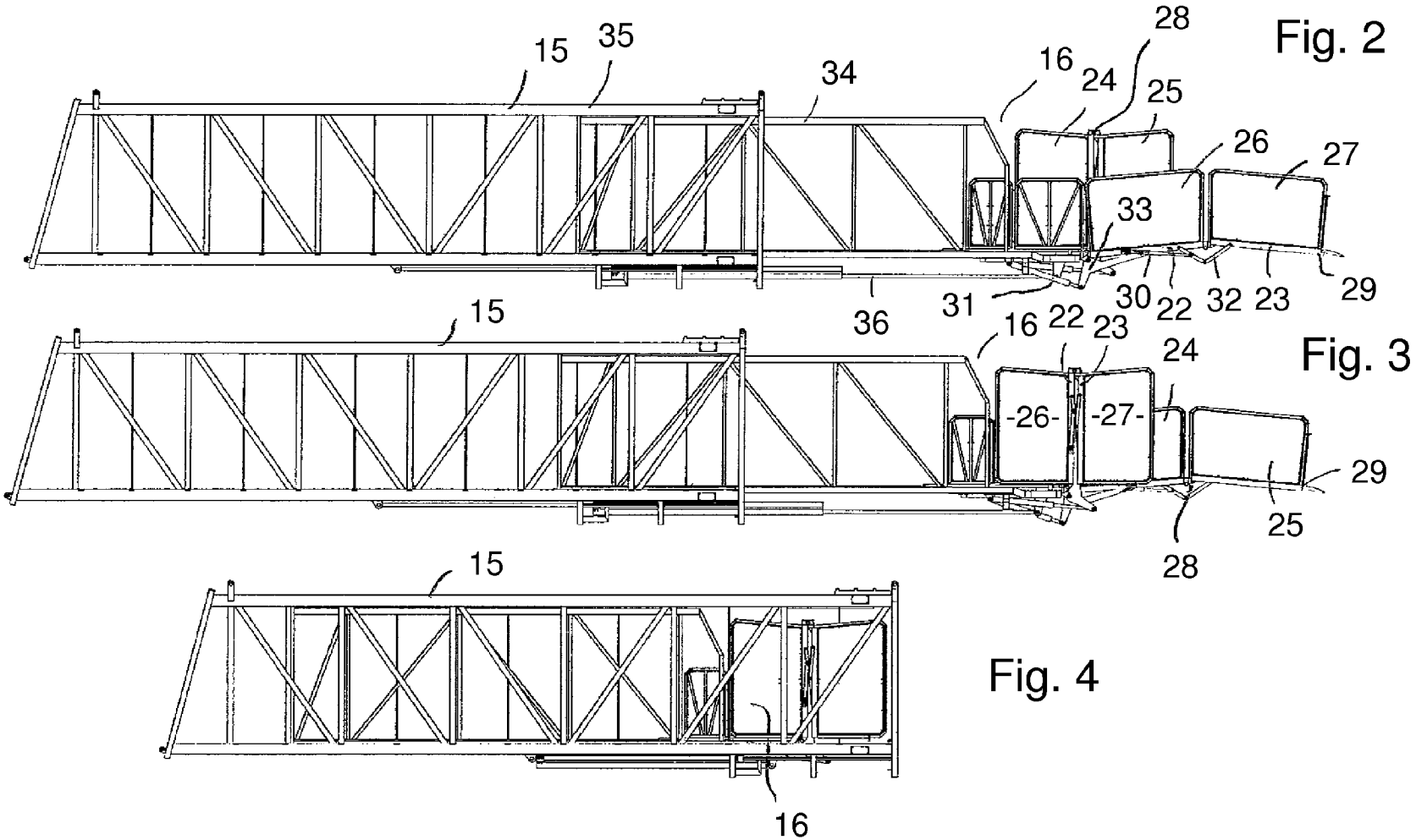
FIGS. 2 and 3 show a ramp according to the invention from the side in a projected and expanded state, respectively, where
FIG. 4 shows the ramp in a pulled in state.
Figure 6:
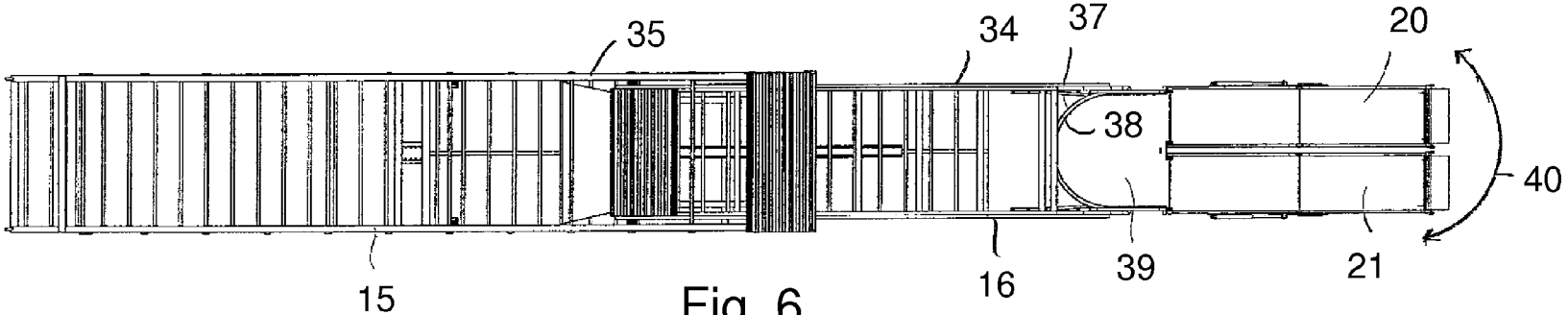
FIG. 6 shows the ramp from above and in a pushed out and expanded state, and illustrates that the ramp is pivotable at its outer end.

According to the invention, the ramp 16, 17 comprises two or more parallel footpaths 22, 23 for passengers, see FIG. 6. Each footpath 22, 23 is supported by a plate 20, 21 which is foldable so that it can be folded out and folded up. Each plate 20, 21 is essentially horizontal in its folded out position or state, see FIG. 2, and essentially vertical in its folded up position or state, see FIG. 3. In FIG. 2, the footpath closest to the observer is shown folded out and the other footpath folded up. In FIG. 3, the footpath closest to the observer is shown folded up and the other footpath folded out.

According to a preferred embodiment, each plate 20, 21 is arranged to be folded up about a joint 28, like a hinge joint arranged perpendicularly to the longitudinal extension of the plates, and that, during folding up, the outer end 29 of the plate is arranged to move horizontally while the said joint 28 moves upwards in FIGS. 2 and 3.

In the folded up state of the plate, the plate thus forms a vertical wall for blocking of the footpath in question.

According to a preferred embodiment, screen walls 24, 25; 26, 27 or fences are fastened to the longitudinal sides of each plate, which screen walls or fences are fastened perpendicularly to the planes of the respective plates.

According to a preferred embodiment, each plate 20, 21 is individually maneuverable between its folded in state and its folded out state, using hydraulic cylinders 30, 31 and a link arm system, which are connected to supporting arms 32, 33 in turn pivotally fastened to the respective under surfaces of the plates. The mechanical system for maneuvering the plates 20, 21 can be accomplished in various ways known to the man skilled in the art.

It is preferred that the ramp comprises an inner section 34, which is telescopable relative to an outer part 35 of the finishing section 15, and that the plates 20, 21 are fastened to the outer end of the inner telescopable section. Suitably, telescoping of the inner section 34 takes place using one or several not shown hydraulic cylinders, in a way corresponding to the one for passenger bridges for airplanes.

Moreover, it is preferred that each plate 20, 21 is, with one of its ends, pivotally fastened to the inner section 34, and that the other, free end of each plate is arranged to, in its folded out state, extend into the opening in the hull of the ship, and to abut against a deck inside the ship during docking with the ship.

Figure 5:
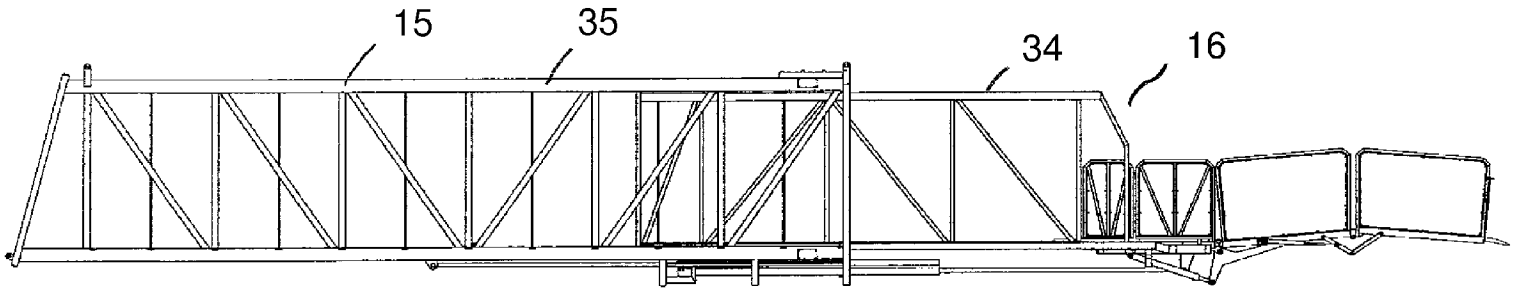
FIG. 5 shows the ramp from the side in a pushed out and expanded state.

FIGS. 2 and 3 show the ramp when only one footpath is folded out, while the other is folded in. FIGS. 5 and 6 show the ramp when both of the two footpaths are folded out.

According to a preferred embodiment, the outer end of the inner telescopable section 34 is designed so that it is pivotal to a limited extent about a vertical axis, as illustrated by arrow 40, see FIG. 6. In this case, the outer end of the inner section 34 is designed as a semi circle 37, which cooperates with the inner part of a footpath plane 39, which has a semi circular end 38, in turn cooperating with the semi circular part of the inner section. This turning possibility facilitates the docking to a ship.

Furthermore, in the folded in state of the ramp, it is preferred that the plates are completely pulled in into the outer end of the said inner telescopable section 34, as illustrated in FIG. 4. The maneuvering of the plates relative to the inner section 34 takes place using the hydraulic cylinders 36.

When the passenger bridge is to be docked to a ship, the plates 20,21 are displaced out from the inner section 34, after which the plates are folded out from a vertical position to a horizontal position. Thereafter, the inner section 34 is displaced out from the outer section 35 of the finishing section 15 until the outer one of the plates is inserted at least partly into the ship and abuts against the deck of the ship.

Above, a number of different embodiments have been described. However, it is apparent that the invention can be varied regarding the design of the plates, the finishing section and the maneuvering means, as well as regarding the number of sections. For example, the number of footpaths can be more than two, for example three, four or five.

The present invention thus solves the initially mentioned problem, and offers a passenger bridge which is adaptable to the width of the ship opening.

The present invention shall therefore not be considered limited to the above described embodiments, but may be varied within the scope of the enclosed claims.

The invention claimed is:

1. A ramp for a movable passenger bridge for embarking and disembarking passengers to and from a ship, which passenger bridge comprises a number of movable sections (2, 3, 4) of the passenger bridge, arranged to be adapted to an opening in the hull of a ship, which sections are arranged so that passengers can walk from one section into an adjacent section and to a finishing section (15) arranged to be connected to an opening in the hull of the ship, wherein said ramp is arranged at the finishing section and projects from the finishing section into the ship when docked with the ship, wherein the ramp (16, 17) comprises two or more parallel footpaths for passengers, and each footpath comprises a plate (20,21) which is foldable so that the footpath can be folded out and folded up, wherein each plate (20, 21) is essentially horizontal in a folded-out state and essentially vertical in a folded-up state, each plate (20, 21) is arranged to be folded up about a joint (28) arranged perpendicularly to a longitudinal direction of the plates, when a plate is folded up, a free end (29) of the plate is arranged to move horizontally while the said joint moves upwards so that each plate in the folded-up state forms a wall for blocking of the footpath in question, and each plate (20, 21) is individually maneuverable between the folded-up state and the folded-out state, wherein the ramp (16,17) further comprises an inner telescopable section (34), which is telescopable relative to an outer part (35) of the finishing section (15), and the plates (20, 21) are fastened to an outer end of the inner telescopable section (34), and wherein screen walls (24, 25; 26, 27) or fences are fastened to the longitudinal sides of each plate (20, 21), which screen walls or fences are fastened perpendicularly to planes of the plates.

2. The ramp according to claim 1, wherein, one end of each plate (20, 21) is pivotally fastened to the said inner section (34), and the other, free end (29) of each plate is arranged to, in the folded-out state, abut against a deck in the ship when docked with the ship.

3. The ram according to claim 2, wherein, the outer end of the inner telescopable section (34) is arranged to be pivotal to a limited extend about a vertical axis.

4. A ramp according to claim 1, wherein, each plate (20, 21) is individually maneuverable between the folded-up state and the folded-out state using hydraulic cylinders (30, 31), which are connected to support arms (32, 33) which are in turn pivotally fastened to a respective surface of the underside of the plates.

5. A ramp according to claim 2, wherein, each plate (20, 21) is individually maneuverable between the folded-up state and the folded-out state using hydraulic cylinders (30, 31), which are connected to support arms (32, 33) which are in turn pivotally fastened to a respective surface of the underside of the plates.

6. A ramp according to claim 3, wherein, each plate (20, 21) is individually maneuverable between the folded-up state and the folded-out state using hydraulic cylinders (30, 31), which are connected to support arms (32, 33) which are in turn pivotally fastened to a respective surface of the underside of the plates.

7. A ramp according to claim 1, wherein, in a folded-up state of the ramp (16, 17), the ramp is arranged to be completely pulled into the outer end of the said inner telescopable section (34).

8. A ramp according to claim 2, wherein, in a folded-up state of the ramp (16, 17), the ramp is arranged to be completely pulled into the outer end of the said inner telescopable section (34).

9. A ramp according to claim 3, wherein, in a folded-up state of the ramp (16, 17), the ramp is arranged to be completely pulled into the outer end of the said inner telescopable section (34).

10. A ramp according to claim 4, wherein, in a folded-up state of the ramp (16, 17), the ramp is arranged to be completely pulled into the outer end of the said inner telescopable section (34).

11. A ramp according to claim 5, wherein, in a folded-up state of the ramp (16, 17), the ramp is arranged to be completely pulled into the outer end of the said inner telescopable section (34).

12. A ramp according to claim 6, wherein, in a folded-up state of the ramp (16, 17), the ramp is arranged to be completely pulled into the outer end of the said inner telescopable section (34).

13. A ramp according to claim 1, wherein the joint is a hinge joint.

* * * * *